United States Patent [19]

Hintsch

[11] 4,230,158

[45] Oct. 28, 1980

[54] CLEANING MEANS FOR A WEAVING MACHINE

[75] Inventor: Otto Hintsch, Wallisellen, Switzerland

[73] Assignee: Sulzer Brothers Ltd., Winterthur, Switzerland

[21] Appl. No.: 957,088

[22] Filed: Nov. 3, 1978

[30] Foreign Application Priority Data

Nov. 7, 1977 [CH] Switzerland ..... 13504/77

[51] Int. Cl.[2] ..... D03J 1/04

[52] U.S. Cl. ..... 139/1 C

[58] Field of Search ..... 139/1 R, 1 C; 15/345; 134/37

[56] References Cited

U.S. PATENT DOCUMENTS

| | | | |
|---|---|---|---|
| 2,400,792 | 5/1946 | Turner | 139/1 C |
| 2,584,043 | 1/1952 | Oberly | 134/37 |
| 3,127,911 | 4/1964 | Maguire | 139/1 C |
| 3,542,595 | 11/1970 | McCullough et al. | 134/37 |

*Primary Examiner*—Henry Jaudon

*Attorney, Agent, or Firm*—Kenyon & Kenyon

[57] ABSTRACT

The cleaning means employs a nozzle on one side of the picking mechanism which directs a stream of air over the weft yarn in a direction opposite the picking direction to pass through the picking station as well as a funnel on the opposite side of the picking mechanism to receive and exhaust the air with any entrained foreign matter from the picking station.

7 Claims, 3 Drawing Figures

CLEANING MEANS FOR A WEAVING MACHINE

This invention relates to a cleaning means for a weaving machine.

As is known, for example from U.S. Pat. No. 3,391,528, attempts have been made in the past to clean weaving machines or looms by encasing the entire machine in a housing and by blowing air through the encased machine. However, in these situations, the air stream is usually strongest at the center of the machine. As a result, some of the machine units, such as the picking mechanism, are not effectively cleaned. Thus, in the course of time, there is a considerable build-up of foreign matter on and in these units. This, of course, eventually requires a shut-down of the machine in order to clean these units. Further, the foreign matter on these units may soil the yarns being handled and, thus, the resultant cloth.

Accordingly, it is an object of this invention to provide a more effective way of cleaning a weaving machine during operation.

It is another object of the invention to reliably clean a picking mechanism of a weaving machine during operation.

It is another object of the invention to provide a relatively simple means for cleaning a picking mechanism of a weaving machine.

It is another object of the invention to provide for an intensive cleaning of a weft yarn and a picking mechanism for picking the weft yarn into a shed.

Briefly, the invention provides a weaving machine which has a weft picking mechanism for picking a picking means in a predetermined picking direction into a shed with means for passing a stream of cleaning air over the weft yarn in a direction opposite the direction of travel of the weft yarn and substantially parallel to the weft yarn to remove foreign matter from the picking mechanism as well as the weft yarn.

The cleaning means permits a very intensive cleaning of the picking mechanism, particularly near a picking station of the picking mechanism where, because of various deflections, such as yarn loops and so on, very heavy concentrations of dust, fluff, residues of yarn finishing agent and so on occur. Cleaning occurs as a result of the air stream which moves in the opposite direction to the picking direction and which picks up and removes particles which have separated from the weft material. The fact that the air stream is moving opposite to the picking direction makes very certain that particles of dust can be kept away from the cloth being woven on the machine.

Figure 1:
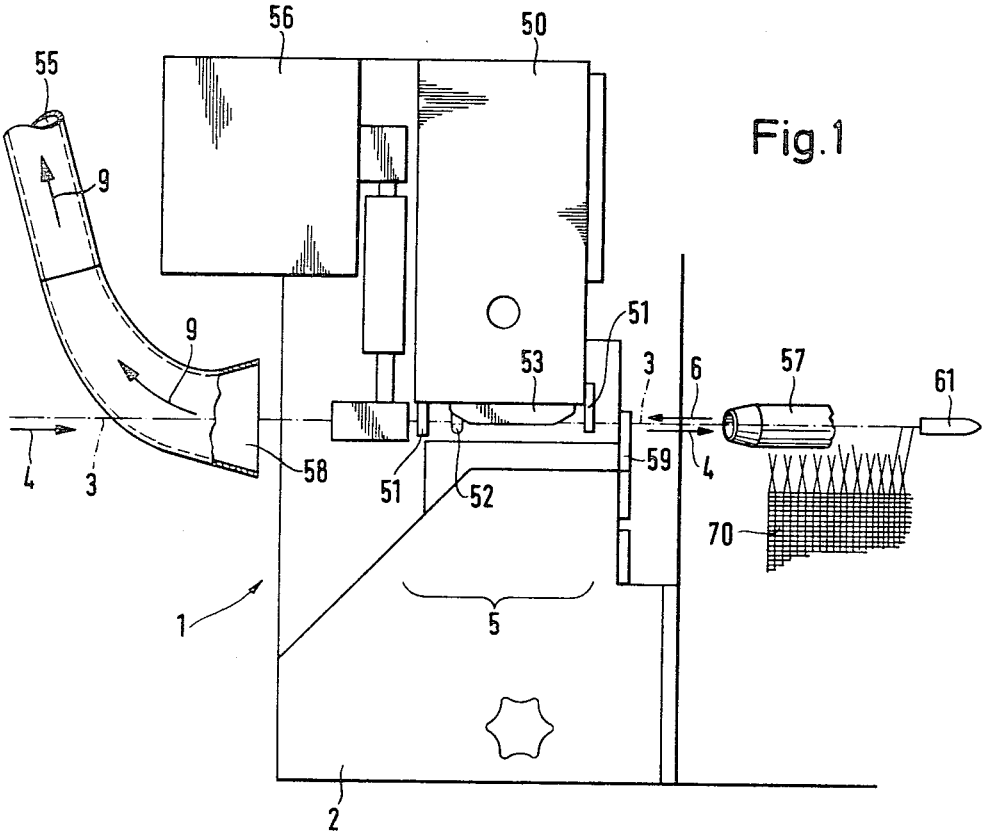
Figure 2:
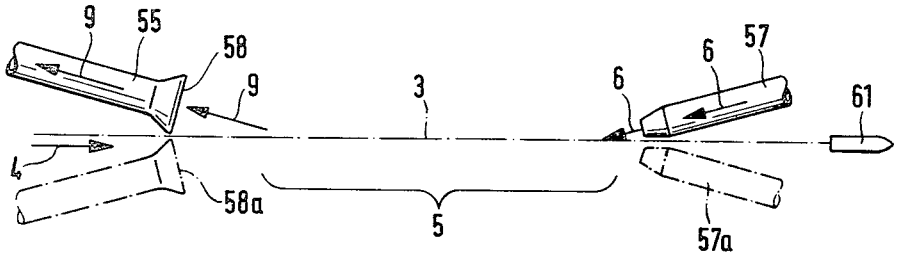
Figure 3:
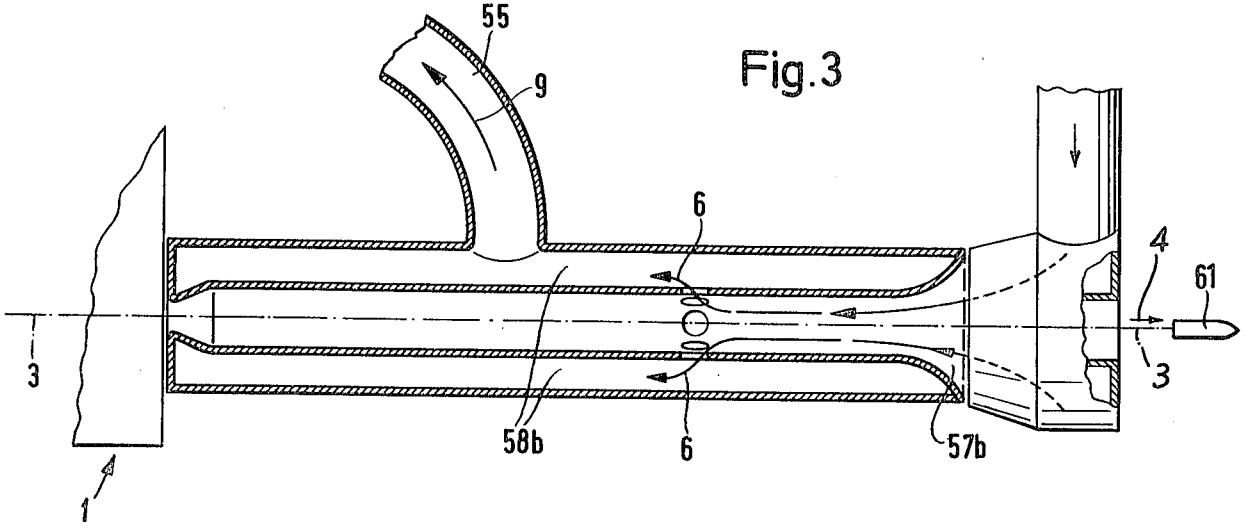

These and other objects and advantages of the invention will become more apparent from the following detailed description taken in conjunction with the accompanying drawings wherein:

FIG. 1 illustrates a plan view in diagrammatic form of a picking mechanism of a weaving machine having a cleaning means according to the invention;

FIG. 2 schematically illustrates a view corresponding to FIG. 1 of a picking station and possible variants of the components of a cleaning means according to the invention, and FIG. 3 illustrates a modified cleaning means according to the invention.

Referring to FIG. 1, the weft picking mechanism 1 of a weaving machine is of generally conventional construction and need not be described in particular detail.

As indicated, the picking mechanism 1 is positioned on one side of the weaving machine to pick a weft yarn 3 in a predetermined picking direction as indicated by the arrows 4 into a shed (not shown) formed of warp yarns to form a cloth 70 in known manner.

The picking mechanism 1 has three conventional drive units 2, 50, 56 for the various elements of the mechanism such as a shuttle (or projectile) striker, two openers 51 for a yarn transfer element, an opener 52 for picking means, such as a gripper shuttle or projectile 61, a shuttle lift 53, an edge yarn clamp 59 and so on. In addition, the picking mechanism 1 has a shooting or picking station 5 where a yarn end connected to a weft supply bobbin is offered by the yarn transfer element (not shown) to the gripper shuttle 61 and engaged by a clamp (not shown) of the shuttle 61.

In order to clean the picking mechanism 1, a means is provided for passing a stream of cleaning air over the weft yarn 3 in a direction opposite the picking direction 4 and substantially parallel to the weft yarn 3. This means includes an air discharge nozzle 57 on one side of the picking mechanism 1 for discharging a stream of cleaning air from a suitable source (not shown) towards the picking mechanism 1 for passage through the mechanism 1 in the direction indicated by an arrow 6. In addition, the cleaning means includes an exhaust funnel 58 on an opposite side of the picking mechanism 1 for exhausting the stream of cleaning air away from the mechanism 1 after passage through the mechanism 1. The funnel 58 is, in turn, connected with an exhaust line 55 through which the air can be discharged together with foreign matter in the direction as indicated by an arrow 9. The discharge nozzle 57 and funnel 58 are positioned with the nozzle 57 directed towards the funnel 58 so that the cleaning air flows through the picking mechanism straight into the funnel 58.

As shown, the nozzle 57 is located between the picking mechanism 1 and the cloth 70.

During operation of the weaving machine and picking mechanism 1, a stream of cleaning air passes through the picking station 5 and mechanism 1 from right to left as viewed in FIG. 1. Consequently, any particles of dust, residues of finishing agent or the like accumulating in the picking mechanism 1 can be picked up very intensively by the air stream and conveyed towards the funnel 58. The air is then discharged together with the dust particles in the direction indicated by the arrow 9.

The cleaning air can be injected through the nozzle 57 either constantly or intermittently, e.g., only during picking or, for instance, every fifth or tenth pick or on a timed basis, e.g. a one or three-second pulse or "burst" of air every ten seconds, and so on.

Of course, any foreign matter on the weft yarn 3 within the picking station will also be picked up by the scavenging air stream to the extent that such is possible.

Referring to FIG. 2, wherein like reference characters indicate like components as above, the components of the cleaning means may be arranged in any suitable position relative to the weft yarn 3 in the picking station 5. For example, the nozzle 57 and funnel 58 may be disposed immediately above the weft yarn 3 as shown in solid line or the nozzle **57*a* and funnel 58*a* may be disposed immediately below the weft yarn 3** as shown in dotted line.

Referring to FIG. 3, the cleaning means may alternatively be constructed with an elongated nozzle **57*b* disposed in the path of the shuttle 61 for passage of the shuttle 61 and trailing weft yarn 3 therethrough. This nozzle 57***b* has a tapered inlet at the end remote from the picking mechanism (not shown) for receiving a stream of cleaning air from a suitable source (not shown) as well as a plurality of circumferentially disposed apertures at an intermediate point for expelling air. The other end of the nozzle 57*b* is narrowed to present a reduced opening for entry of the shuttle 61. In addition, a tubular member 58*b* surrounds the nozzle 57*b* to define a closed annular chamber and an exhaust line 55 is connected to the tubular member 58*b* in communication with the annular chamber to exhaust the cleaning air therefrom.

In this embodiment, the shuttle 61 passes directly into the nozzle 57*b* with a minimal amount of cleaning air being passed out of the end of the nozzle 57*b*. Instead, the cleaning air cleans the weft yarn 3 and passes through the circumferential apertures in the nozzle 57*b* into the surrounding closed chamber and, thence, out the exhaust line 55. In this case, the cleaning air does not pass through the picking mechanism (not shown).

Where suitable, the exhaust lines 55 can be connected to a vacuum source so that the cleaning air and the entrained foreign matter can be more positively removed.

What is claimed is:

1. In combination with a weft picking mechanism of a weaving machine for picking a picking means in a predetermined picking direction into a shed formed in the weaving machine with a weft yarn trailing therefrom, said picking mechanism having a picking station wherein a weft yarn is engaged with the picking means, means for passing a stream of cleaning air over the weft yarn in said picking station in a direction opposite said predetermined picking direction and substantially parallel to the weft yarn to remove foreign matter from said picking mechanism.

2. The combination as set forth in claim 1 wherein said means for passing the air stream over the weft yarn includes an extraction means for extracting the cleaning air from said picking mechanism.

3. The combination as set forth in claim 2 wherein said extraction means has an aperture disposed on an upstream side of said picking mechanism relative to said predetermined direction and wherein said means for passing the air stream over the weft yarn further includes an air discharge nozzle on a downstream side of said picking mechanism relative to said predetermined direction for directing the air stream towards said extraction aperture.

4. In combination a picking mechanism for picking a gripper shuttle in a predetermined picking direction into a shed with a weft yarn trailing therefrom; and a means for passing a stream of cleaning air over the weft yarn in a direction opposite said predetermined picking direction and parallel to the weft yarn therein to remove foreign matter from at least one of the weft yarn and the picking mechanism.

5. The combination as set forth in claim 4 wherein said means for passing the air stream over the weft yarn includes an air discharge nozzle on one side of said picking mechanism for discharging the stream of cleaning air towards said picking mechanism and an exhaust funnel on an opposite side of said picking mechanism for exhausting the stream of cleaning air away from said picking mechanism after passage through said picking mechanism.

6. The combination as set forth in claim 5 wherein said nozzle is directed toward said funnel.

7. The combination as set forth in claim 4 wherein said means for passing the air stream over the weft yarn includes an elongated nozzle in the path of the gripper shuttle for passage of the gripper shuttle and weft yarn therethrough, said nozzle having a tapered inlet at an end remote from said picking mechanism for receiving the stream of cleaning air and a plurality of circumferentially disposed apertures at an intermediate point for expelling the air therefrom, a tubular member surrounding said nozzle to define a closed annular chamber, and an exhaust line connected to said tubular member in communication with said annular chamber to exhaust cleaning air therefrom.

* * * * *